US009964266B2

(12) United States Patent
Danesh

(10) Patent No.: US 9,964,266 B2
(45) Date of Patent: May 8, 2018

(54) UNIFIED DRIVER AND LIGHT SOURCE ASSEMBLY FOR RECESSED LIGHTING

(71) Applicant: Michael D. Danesh, Beverly Hills, CA (US)

(72) Inventor: Michael D. Danesh, Beverly Hills, CA (US)

(73) Assignee: DMF, Inc., Carson, CA (US)

( * ) Notice: Subject to any disclaimer, the term of this patent is extended or adjusted under 35 U.S.C. 154(b) by 0 days. days.

(21) Appl. No.: 14/184,601

(22) Filed: Feb. 19, 2014

(65) Prior Publication Data

US 2015/0009676 A1 Jan. 8, 2015

Related U.S. Application Data

(60) Provisional application No. 61/843,278, filed on Jul. 5, 2013.

(51) Int. Cl.
*F21V 15/00* (2015.01)
*F21S 8/02* (2006.01)
(Continued)

(52) U.S. Cl.
CPC ..... *F21S 8/02* (2013.01); *H04R 17/00* (2013.01); *H04R 23/02* (2013.01); *H04R 1/24* (2013.01); *H04R 2499/11* (2013.01)

(58) Field of Classification Search
CPC ..... F21S 8/02; H04R 1/24
(Continued)

(56) References Cited

U.S. PATENT DOCUMENTS 2,038,784 A 4/1936 Ghadiali
3,422,261 A 1/1969 McGinty
(Continued)

FOREIGN PATENT DOCUMENTS

CA 2815067 11/2013
CN 201259125 Y 6/2009
(Continued)

OTHER PUBLICATIONS

Non-Final Office Action (dated Oct. 16, 2014), U.S. Appl. No. 13/484,901, filed May 31, 2012, First Named Inventor: Michael D. Danesh, 15 pages.
(Continued)

*Primary Examiner* — Tsion Tumebo

(57) ABSTRACT

A compact recessed lighting system is provided. The lighting system includes a light source module and a driver separately coupled to a unified casting. The driver is formed in a "donut" shape such that the light source module may be coupled to the casting in the center hole formed by the driver. The lighting system may also include a reflector that surrounds the light source module and shields the driver from exposure to the area surrounding the lighting system. Based on this configuration, the lighting system provides a compact design that allows the combined casting, light source module, driver, and reflector to be installed in a standard junction box instead of a "can" housing structure to reduce the overall cost of the lighting system while still complying with all building and safety codes/regulations. This configuration also allows the lighting system to achieve a UL fire-rating of at least two hours.

30 Claims, 3 Drawing Sheets

(51) Int. Cl.
*H04R 17/00* (2006.01)
*H04R 23/02* (2006.01)
*H04R 1/24* (2006.01)

(58) Field of Classification Search
USPC ..... 362/296.1, 364
See application file for complete search history.

(56) References Cited

U.S. PATENT DOCUMENTS 3,460,299 A 8/1969 Wilson
3,650,046 A 3/1972 Skinner
4,088,827 A * 5/1978 Kohaut ..... 174/483
4,399,497 A 8/1983 Druffel
4,520,435 A 5/1985 Baldwin
4,601,145 A 7/1986 Wilcox
4,723,747 A 2/1988 Karp et al.
4,729,080 A 3/1988 Fremont et al.
4,754,377 A * 6/1988 Wenman ..... F21S 8/02 362/148
4,930,054 A 5/1990 Krebs
5,216,203 A * 6/1993 Gower ..... H02G 3/088 174/152 G
5,250,269 A 10/1993 Langer et al.
5,382,752 A * 1/1995 Reyhan ..... H02G 3/088 174/38
5,465,199 A * 11/1995 Bray ..... F21S 8/02 362/147
5,544,870 A 8/1996 Kelley et al.
5,562,343 A 10/1996 Chan et al.
5,580,158 A 12/1996 Aubrey et al.
5,588,737 A 12/1996 Kusmer
D381,111 S 7/1997 Lecluze
5,662,413 A 9/1997 Akiyama
D386,277 S 11/1997 Lecluze
D387,466 S 12/1997 Lecluze
5,836,678 A 11/1998 Wright et al.
5,942,726 A * 8/1999 Reiker ..... E04B 9/006 174/58
5,944,412 A 9/1999 Janos et al.
6,082,878 A 7/2000 Doubek et al.
6,105,334 A 8/2000 Monson et al.
6,161,910 A 12/2000 Reisenauer et al.
6,174,076 B1 1/2001 Petrakis et al.
6,267,491 B1 7/2001 Parrigin
6,350,043 B1 2/2002 Gloisten
6,364,511 B1 4/2002 Cohen
6,474,846 B1 11/2002 Kelmelis et al.
6,491,413 B1 * 12/2002 Benesohn ..... 362/294
6,583,573 B2 6/2003 Bierman
6,585,389 B2 7/2003 Bonazzi
D488,583 S 4/2004 Benghozi
6,719,438 B2 4/2004 Sevack et al.
6,758,578 B1 7/2004 Chou
D509,314 S 9/2005 Rashidi
6,948,829 B2 9/2005 Verdes et al.
6,964,501 B2 11/2005 Ryan
D516,235 S 2/2006 Rashidi
D528,673 S 9/2006 Maxik et al.
D531,740 S 11/2006 Maxik
D532,532 S 11/2006 Maxik
7,186,008 B2 3/2007 Patti
7,190,126 B1 3/2007 Paton
D547,889 S 7/2007 Huang
D553,267 S 10/2007 Yuen
7,320,536 B2 * 1/2008 Petrakis ..... F21V 25/00 362/147
D561,372 S 2/2008 Yan
D561,373 S 2/2008 Yan
D570,012 S 5/2008 Huang
7,374,308 B2 5/2008 Sevack et al.
D570,504 S 6/2008 Maxik et al.
D570,505 S 6/2008 Maxik et al.
7,399,104 B2 7/2008 Rappaport
D578,677 S 10/2008 Huang
7,431,482 B1 10/2008 Morgan et al.
7,473,005 B2 1/2009 O'Brien
7,488,097 B2 2/2009 Reisenauer et al.
7,503,145 B2 * 3/2009 Newbold ..... F21S 8/02 52/27
7,524,089 B2 4/2009 Park
D591,894 S 5/2009 Flank
7,534,989 B2 5/2009 Suehara et al.
7,566,154 B2 7/2009 Gloisten et al.
D599,040 S 8/2009 Alexander et al.
D600,836 S 9/2009 Hanley et al.
7,588,359 B2 9/2009 Coushaine et al.
7,592,583 B2 9/2009 Page et al.
7,625,105 B1 12/2009 Johnson
7,628,513 B2 12/2009 Chiu
7,651,238 B2 1/2010 O'Brien
7,654,705 B2 2/2010 Czech et al.
D611,650 S 3/2010 Broekhoff
7,670,021 B2 3/2010 Chou
7,677,766 B2 3/2010 Boyer
D616,118 S 5/2010 Thomas et al.
7,722,208 B1 * 5/2010 Dupre ..... F21S 8/02 362/147
7,722,227 B2 5/2010 Zhang et al.
7,748,887 B2 7/2010 Zampini, II et al.
7,771,082 B2 8/2010 Peng
D624,692 S 9/2010 Mackin et al.
D625,847 S 10/2010 Maglica
D625,876 S 10/2010 Chen et al.
D627,727 S 11/2010 Alexander et al.
7,828,465 B2 11/2010 Roberge et al.
7,871,184 B2 1/2011 Peng
D633,224 S 2/2011 Lee
D636,903 S 4/2011 Torenbeek
D637,339 S 5/2011 Hasan et al.
D637,340 S 5/2011 Hasan et al.
7,950,832 B2 5/2011 Tanaka et al.
D639,499 S 6/2011 Choi et al.
7,959,332 B2 6/2011 Tickner et al.
7,967,480 B2 6/2011 Pickard et al.
7,972,035 B2 7/2011 Boyer
7,972,043 B2 7/2011 Schutte
D643,970 S 8/2011 Kim et al.
D646,011 S 9/2011 Rashidi
8,038,113 B2 10/2011 Fryzek et al.
D648,476 S 11/2011 Choi et al.
D648,477 S 11/2011 Kim et al.
D650,115 S 12/2011 Kim et al.
8,070,328 B1 12/2011 Knoble et al.
8,096,670 B2 * 1/2012 Trott ..... F21S 8/02 362/147
D654,205 S 2/2012 Rashidi
D656,263 S 3/2012 Ogawa et al.
8,142,057 B2 3/2012 Roos et al.
8,152,334 B2 4/2012 Krogman
D658,788 S 5/2012 Dudik et al.
D658,802 S 5/2012 Chen
D659,862 S 5/2012 Tsai
D659,879 S 5/2012 Rashidi
D660,814 S 5/2012 Wilson
8,182,116 B2 5/2012 Zhang et al.
8,201,968 B2 6/2012 Maxik et al.
D663,058 S 7/2012 Pan
D663,466 S 7/2012 Rashidi
D664,274 S 7/2012 de Visser et al.
D664,705 S 7/2012 Kong et al.
8,215,805 B2 * 7/2012 Cogliano ..... F21S 8/02 362/364
8,220,970 B1 * 7/2012 Khazi et al. ..... 362/294
8,226,270 B2 7/2012 Yamamoto et al.
D667,155 S 9/2012 Rashidi
8,262,255 B1 9/2012 Rashidi
D668,809 S 10/2012 Rashidi
D669,198 S 10/2012 Qui
D669,199 S 10/2012 Chuang
D669,620 S 10/2012 Rashidi
8,277,090 B2 10/2012 Fryzek et al.
D673,869 S 1/2013 Yu
8,376,593 B2 2/2013 Bazydola et al.

(56) References Cited

U.S. PATENT DOCUMENTS

D677,417 S 3/2013 Rashidi
D679,047 S 3/2013 Tickner et al.
8,403,533 B1 3/2013 Paulsel
8,403,541 B1 3/2013 Rashidi
D681,259 S 4/2013 Kong
8,408,759 B1 4/2013 Rashidi
D683,063 S 5/2013 Lopez et al.
D683,890 S 6/2013 Lopez et al.
D684,269 S 6/2013 Wang et al.
D684,719 S 6/2013 Rashidi
D685,118 S 6/2013 Rashidi
D685,120 S 6/2013 Rashidi
8,454,204 B1 6/2013 Chang et al.
D685,507 S 7/2013 Sun
D687,586 S 8/2013 Rashidi
D687,587 S 8/2013 Rashidi
D687,588 S 8/2013 Rashidi
D687,980 S 8/2013 Gravely et al.
D688,405 S 8/2013 Kim et al.
D690,049 S 9/2013 Rashidi
D690,864 S 10/2013 Rashidi
D690,865 S 10/2013 Rashidi
D690,866 S 10/2013 Rashidi
D691,314 S 10/2013 Rashidi
D691,315 S 10/2013 Samson
8,550,669 B2 10/2013 Macwan et al.
D693,043 S 11/2013 Schmalfuss et al.
D693,517 S 11/2013 Davis
D694,456 S 11/2013 Rowlette, Jr. et al.
2,815,067 A1 11/2013 Kathawate et al.
D695,441 S 12/2013 Lui et al.
D696,446 S 12/2013 Huh
D696,447 S 12/2013 Huh
D696,448 S 12/2013 Huh
8,602,601 B2 12/2013 Khazi et al.
D698,067 S 1/2014 Rashidi
D698,068 S 1/2014 Rashidi
D698,985 S 2/2014 Lopez et al.
D699,384 S 2/2014 Rashidi
D700,387 S 2/2014 Snell
8,641,243 B1 * 2/2014 Rashidi ..... F21S 8/02 257/712
D701,466 S 3/2014 Clifford et al.
8,672,518 B2 3/2014 Boomgaarden et al.
D702,867 S 4/2014 Kim et al.
D703,843 S 4/2014 Cheng
8,684,569 B2 4/2014 Pickard et al.
D705,472 S 5/2014 Huh
D710,529 S 8/2014 Lopez et al.
8,801,217 B2 8/2014 Oehle et al.
D714,989 S 10/2014 Rowlette, Jr. et al.
8,870,426 B2 10/2014 Biebl et al.
8,890,414 B2 11/2014 Rowlette, Jr. et al.
D721,845 S 1/2015 Lui et al.
8,950,898 B2 * 2/2015 Catalano ..... F21S 8/02 362/249.02
D726,363 S 4/2015 Danesh
9,039,254 B2 5/2015 Danesh
D731,689 S 6/2015 Bernard et al.
9,062,866 B1 6/2015 Christ et al.
9,068,719 B2 6/2015 Van De Ven et al.
9,078,299 B2 7/2015 Ashdown
D739,590 S 9/2015 Redfern
9,140,441 B2 9/2015 Goelz et al.
9,151,457 B2 10/2015 Pickard et al.
9,151,477 B2 10/2015 Pickard et al.
9,285,103 B2 3/2016 Van De Ven et al.
9,291,319 B2 3/2016 Kathawate et al.
9,301,362 B2 3/2016 Dohn et al.
9,310,038 B2 4/2016 Athalye
9,347,655 B2 5/2016 Boomgaarden et al.
D762,181 S 7/2016 Lin
D762,906 S 8/2016 Jeswani et al.
D764,079 S 8/2016 Wu
9,417,506 B1 8/2016 Tirosh
D768,325 S 10/2016 Xu
D768,326 S 10/2016 Guzzini
D769,501 S 10/2016 Jeswani et al.
D770,065 S 10/2016 Tittle
9,476,552 B2 10/2016 Myers et al.
D776,324 S 1/2017 Gierl et al.
9,534,751 B2 1/2017 Maglica et al.
D778,484 S 2/2017 Guzzini
9,581,302 B2 2/2017 Danesh
9,599,315 B1 3/2017 Harpenau et al.
9,605,910 B2 3/2017 Swedberg et al.
D785,228 S 4/2017 Guzzini
D786,472 S 5/2017 Redfern
D786,474 S 5/2017 Fujisawa
D790,102 S 6/2017 Guzzini
9,702,516 B1 7/2017 Vasquez et al.
9,791,111 B1 10/2017 Huang et al.
D809,176 S 1/2018 Partington
2002/0172047 A1 11/2002 Ashley
2005/0225966 A1 10/2005 Hartmann et al.
2005/0227536 A1 10/2005 Gamache et al.
2005/0237746 A1 10/2005 Yiu
2006/0158873 A1 7/2006 Newbold et al.
2006/0215408 A1 9/2006 Lee
2007/0035951 A1 2/2007 Tseng
2007/0185675 A1 8/2007 Papamichael et al.
2007/0206374 A1 9/2007 Petrakis et al.
2008/0112168 A1 5/2008 Pickard et al.
2008/0112170 A1 5/2008 Trott
2008/0112171 A1 5/2008 Patti et al.
2008/0137347 A1 6/2008 Trott et al.
2008/0165545 A1 * 7/2008 O'Brien ..... F21S 8/02 362/364
2008/0232116 A1 9/2008 Kim
2009/0003009 A1 1/2009 Tessnow et al.
2009/0034261 A1 * 2/2009 Grove ..... F21S 8/02 362/294
2009/0080189 A1 3/2009 Wegner
2009/0135613 A1 5/2009 Peng
2009/0141500 A1 6/2009 Peng
2009/0141508 A1 6/2009 Peng
2009/0147517 A1 6/2009 Li
2009/0161356 A1 6/2009 Negley et al.
2009/0237924 A1 9/2009 Ladewig
2009/0280695 A1 11/2009 Sekela et al.
2010/0014282 A1 1/2010 Danesh
2010/0061108 A1 3/2010 Zhang et al.
2010/0110690 A1 5/2010 Hsu et al.
2010/0110698 A1 5/2010 Harwood et al.
2010/0148673 A1 6/2010 Stewart et al.
2010/0149822 A1 6/2010 Cogliano et al.
2010/0244709 A1 9/2010 Steiner et al.
2010/0246172 A1 9/2010 Liu
2010/0259919 A1 10/2010 Khazi et al.
2010/0270903 A1 10/2010 Jao et al.
2010/0302778 A1 12/2010 Dabiet et al.
2011/0063831 A1 3/2011 Cook
2011/0068687 A1 3/2011 Takahasi et al.
2011/0069499 A1 3/2011 Trott et al.
2011/0116276 A1 5/2011 Okamura et al.
2011/0134634 A1 6/2011 Gingrich, III et al.
2011/0134651 A1 6/2011 Berman
2011/0170294 A1 7/2011 Mier-Langner et al.
2011/0194299 A1 8/2011 Crooks et al.
2011/0216534 A1 9/2011 Tickner et al.
2011/0226919 A1 9/2011 Fryzek et al.
2011/0255292 A1 10/2011 Shen
2011/0267828 A1 * 11/2011 Bazydola ..... F21S 8/02 362/373
2012/0020104 A1 1/2012 Biebl et al.
2012/0074852 A1 3/2012 Delnoij
2012/0106176 A1 5/2012 Lopez et al.
2012/0113642 A1 5/2012 Catalano
2012/0140442 A1 6/2012 Woo et al.
2012/0162994 A1 6/2012 Wasniewski et al.
2012/0182744 A1 7/2012 Santiago et al.
2012/0188762 A1 7/2012 Joung et al.
2012/0287625 A1 11/2012 Macwan et al.
2013/0009552 A1 1/2013 Page

(56) References Cited

U.S. PATENT DOCUMENTS

| | | | | |
|---|---|---|---|---|
| 2013/0010476 | A1* | 1/2013 | Pickard et al. | 362/311.03 |
| 2013/0051012 | A1* | 2/2013 | Oehle et al. | 362/235 |
| 2013/0141913 | A1 | 6/2013 | Sachsenweger | |
| 2013/0163254 | A1 | 6/2013 | Chang et al. | |
| 2013/0170233 | A1 | 7/2013 | Nezu et al. | |
| 2013/0258677 | A1 | 10/2013 | Fryzek et al. | |
| 2013/0294084 | A1 | 11/2013 | Kathawate et al. | |
| 2013/0322062 | A1 | 12/2013 | Danesh | |
| 2014/0049957 | A1 | 2/2014 | Goelz et al. | |
| 2014/0140490 | A1 | 5/2014 | Roberts et al. | |
| 2014/0063818 | A1 | 6/2014 | Randolph et al. | |
| 2014/0254177 | A1 | 9/2014 | Danesh | |
| 2014/0347848 | A1 | 11/2014 | Pisavadia et al. | |
| 2015/0198324 | A1 | 7/2015 | O'Brien et al. | |
| 2015/0233556 | A1 | 8/2015 | Danesh | |
| 2015/0276185 | A1 | 10/2015 | Bailey et al. | |
| 2016/0312987 | A1 | 10/2016 | Danesh | |
| 2016/0348860 | A1 | 12/2016 | Danesh | |
| 2016/0348861 | A1 | 12/2016 | Bailey et al. | |
| 2016/0366738 | A1 | 12/2016 | Boulanger et al. | |
| 2017/0045213 | A1 | 2/2017 | Williams et al. | |
| 2017/0138576 | A1 | 5/2017 | Peng et al. | |

FOREIGN PATENT DOCUMENTS

| | | | |
|---|---|---|---|
| CN | 101608781 | | 12/2009 |
| CN | 201636626 | U | 11/2010 |
| CN | 202392473 | U | 11/2011 |
| CN | 103307518 | A | 3/2012 |
| CN | 103322476 | A | 9/2013 |
| CN | 203215483 | U | 9/2013 |
| CN | 20327663 | U | 11/2013 |
| CN | 101498411 | B | 11/2013 |
| CN | 104654142 | A | 11/2013 |
| CN | 203297980 | U | 11/2013 |
| CN | 103712135 | B | 12/2013 |
| CN | 203628464 | U | 12/2013 |
| CN | 203641919 | U | 6/2014 |
| CN | 204513161 | U | 7/2015 |
| CN | 204611541 | U | 9/2015 |
| CN | 204829578 | U | 12/2015 |
| CN | 205606362 | U | 9/2016 |
| CN | 2016130742 | U | 4/2017 |
| CN | 103154606 | B | 5/2017 |
| DE | 9109828 | U1 | 2/1992 |
| EP | 1672155 | A1 | 6/2006 |
| EP | 2 306 072 | A1 | 4/2011 |
| EP | 2 453 169 | A2 | 5/2012 |
| EP | 2 193 309 | B1 | 7/2012 |
| JP | 2011060450 | A2 | 3/2011 |
| JP | 2012064551 | A2 | 3/2012 |
| JP | 2015002027 | A2 | 6/2013 |
| JP | 2015002028 | A2 | 1/2015 |
| JP | 20171076699 | A2 | 6/2017 |
| KR | 1020110008796 | A | 1/2011 |
| KR | 1020120061625 | A | 6/2012 |
| WO | WO 2013/128896 | A1 | 9/2013 |
| WO | WO 2015/000212 | A1 | 1/2015 |
| WO | WO 2016152166 | A2 | 8/2016 |

OTHER PUBLICATIONS

CA Office Action (dated Dec. 23, 2013), Application No. 2,778,581, Date Filed—Jun. 1, 2012, (3 pages).

DMF, Inc., "dmfLighting: LED Recessed Lighting Solutions", Info sheets, (Mar. 19, 2012), (4 pages).

Halo, Halo LED H4 H7 Collection, SustainabLEDesign, Cooper Lighting, (emphasis on p. 18 "H7 Collection LED Modules—Halo LED H7 Module Features"), (Mar. 28, 2012), (52 pages).

Halo, H7 LED Downlight Trims 49x Series, 6-inch LED Trims For Use With ML7x LED Modules, Cooper Lighting, ADV110422, (rev. Aug. 12, 2011), (15 pages).

Halo, LED Module ML706x, Cooper Lighting, Oct. 20, 2009, 4 pages, General Installation for All Modules/p. 1; Tether Installation/pp. 2-3; Installation into HALO H750x Series LED—only (Non-Screw based) Recessed Fixture (p. 4).

Final Office Action (dated Apr. 2, 2015), U.S. Appl. No. 13/484,901, filed May 31, 2012, First Named Inventor: Michael D. Danesh, 13 pages.

Final Office Action (dated Jan. 29, 2016), U.S. Appl. No. 14/183,424, filed Feb. 18, 2014, First Named Inventor: Michael D. Danesh, 21.

CA Office Action (dated Feb. 1, 2016), Application No. 2,879,486, Filing Date: Jan. 23, 2015, First Named Inventor: Michael D. Danesh, 5.

Non-Final Office Action (dated Jun. 2, 2015), U.S. Appl. No. 12/183,424, filed Jan. 18, 2014, First Named Inventor: Michael D. Danesh, 20 pages.

Non-Final Office Action (dated Sep. 15, 2015), U.S. Appl. No. 13/484,901, filed May 31, 2012. First Named Inventor: Michael D. Danesh, 16.

"CA Office Action (dated Dec. 23, 2013), Application No. 2,778,581, Date Filed—Jun. 1, 2012", 3 pages.

CA Office Action (dated Mar. 22, 2016), Application No. 2,879,629, Filing Date: Jan. 23, 2015; First named Inventor: Michael D. Danesh.

Final Office Action (dated Jun. 23, 2016), U.S. Appl. No. 13/484,901, filed May 31, 2012, First Named Inventor: Michael D. Danesh, 18 pages.

"DME Series Installation Instructions", (Oct. 18, 2011).

U.S. Non-Final Office Action, dated May 17, 2017, U.S. Appl. No. 14/183,424.

Canadian Office Action, dated Mar. 9, 2017, Canadian Application No. 2,931,588.

Canadian Office Action, dated Dec. 6, 2016, Canadian Application No. 2,879,629.

Canadian Office Action dated Jun. 12, 2017 from Canadian Application No. 2,927,601, 4 pages.

Canadian Office Action dated Aug. 11, 2017 from Canadian Application No. 2,941,051, 4 pages.

Notice of Allowance dated Aug. 23, 2017 from Canadian Application No. 2,879,629, 1 page.

Notice of Allowance dated Oct. 21, 2016 from U.S. Appl. No. 13/484,901, 7 pages.

2006 International Building Code, Section 712 Penetrations, 2006, 4 pages.

BXUV.GuideInfo, Fire Resistance Ratings—ANSI/UL 263, UL Online Certifications Directory, last updated Nov. 23, 2016, 27 pages.

CEYY.GuideInfo, Outlet Boxes and Fittings Certified for Fire Resistance, UL Online Certifications Directory, last updated May 16, 2013, 2 pages.

DMF, Inc., "dmfLIGHTING: LED Recessed Downlighting," DRD2 Product Brochure, Oct. 23, 2014, 49 pages.

DMF, Inc., "dmfLIGHTING: LED Recessed Downlighting," Product Catalog, Aug. 2012, 68 pages.

"Membrane Penetrations in Fire-Resistance Rated Walls," https://www.ul.com/wp-content/uploads/2014/04/ul_MembranePenetrations.pdf, Issue 1, 2009, 2 pages.

"Metallic Outlet Boxes," UL 514A, Underwriters Laboratories, Inc., Feb. 16, 2004 (Title Page Reprinted Aug. 10, 2007), 106 pages.

"Metallic and Non-metallic Outlet Boxes Used in Fire-rated Assembly," https://iaeimagazine.org/magazine/2000/09/16/metallic-and-non-metallic-outlet-boxes-used-in-fire-rated-assembly/, Sep. 16, 2000, 5 pages.

Non-Final Office Action dated Mar. 15, 2010 from U.S. Appl. No. 12/100,148, 8 pages.

Non-Final Office Action dated Apr. 30, 2010 from U.S. Appl. No. 12/173,232, 13 pages.

Non-Final Office Action dated Sep. 5, 2014 from U.S. Appl. No. 13/791,087, 8 pages.

Notice of Allowance dated Jan. 30, 2015 from U.S. Appl. No. 13/791,087, 9 pages.

Notice of Allowance dated Jan. 16, 2015 from U.S. Appl. No. 29/467,026, 9 pages.

(56) References Cited

OTHER PUBLICATIONS

"Outlet Boxes for Use in Fire Rated Assemblies," https://www.ul.com/wp-content/uploads/2014/04/Ul_outletboxes.pdf, 2011, 2 pages.
Non-Final Office Action dated Feb. 6, 2018 from U.S. Appl. No. 15/167,682, 9 pages.
Non-Final Office Action dated Sep. 6, 2017 from U.S. Appl. No. 14/726,064, 8 pages.
Notice of Allowance dated Mar. 24, 2016 from U.S. Appl. No. 14/247,149, 8 pages.

* cited by examiner

UNIFIED DRIVER AND LIGHT SOURCE ASSEMBLY FOR RECESSED LIGHTING

RELATED MATTERS

This application claims the benefit of the earlier filing date of U.S. provisional application No. 61/843,278, filed Jul. 5, 2013.

FIELD

An embodiment relates to a compact recessed lighting system that includes a light source module and a driver in a single unified casting, which along with an optical light reflector shields the driver from exposure to outside elements and allows the recessed lighting system to be installed in a standard junction box. In some embodiments, this compact recessed lighting system may be utilized in 4-10" recessed new construction and remodel products and in retrofit applications. Moreover, in some embodiments, this compact recessed lighting system may be utilized with interchangeable trims to accommodate different aperture luminaires. Other embodiments are also described.

BACKGROUND

Recessed lighting systems are typically installed or mounted into an opening in a ceiling or a wall. Recessed lighting systems generally consist of a trim, a light source module, a driver, and a "can" housing. The driver is insulated from other portions and components of the recessed lighting system, including the light source module, through the use of a separate insulating container. The driver may be electrically coupled to the light source module through the use of wires or other conduits such that the driver may power the light source module to emit light.

The separation between the driver and the light source module adds to the combined size of the recessed lighting system. In particular, the use of a separate container that houses the driver separate from the other portions and components of the recessed lighting system, including the light source module, increases the size of the recessed lighting system. This increased size restricts the recessed lighting system to be placed in constrained spaces within a ceiling or a wall and may increase the overall cost of the recessed lighting system.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
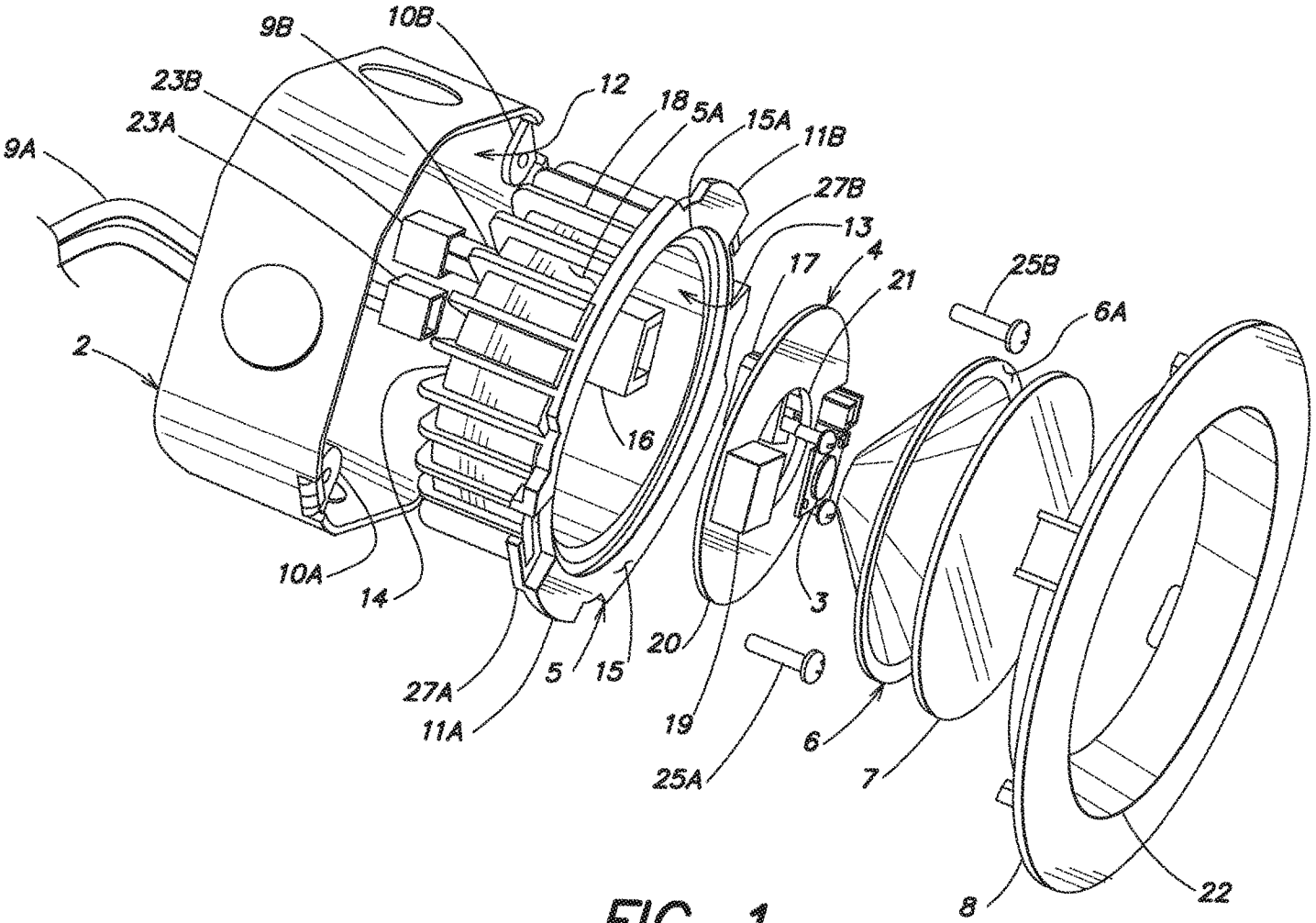
FIG. 1 shows an exploded view of a recessed lighting system according to one embodiment.

FIG. 1 shows an exploded view of a recessed lighting system 1. The recessed lighting system 1 may include a junction box 2, a light source module 3, a driver (e.g., a power supply) 4, a unified casting 5, a reflector 6, a lens 7, and a trim 8. As will be described in further detail below, the recessed lighting system 1 provides a more compact and cost effective design while complying with all building and safety codes/regulations. Although shown with a single junction box 2 and trim 8, the light source module 3, the driver 4, the unified casting 5, the reflector 6, and the lens 7 may be similarly used with different sized junction boxes 2 and trims 8. Each of the elements of the recessed lighting system 1 will be explained by way of example below.

The junction box 2 is a structure that separates the inner components of the recessed lighting system 1, including electrical wires/cables, from the items inside a ceiling or crawl space (e.g., insulation) in which the junction box 2 has been installed. In one embodiment, the junction box 2 is directly coupled to a stud, beam, or other structural member inside the ceiling or crawl space through the use of resins, clips, screws, bolts, clamps, or any other type of connecting mechanism. The junction box 2 may be equipped with one or more bar-hangers to assist installation when the junction box 2 needs to be located between two studs or joists. In one embodiment, the junction box 2 may be a single or double gang box with a fire rating of up to two hours as described in the National Electrical Code (NEC) and by the Underwriters Laboratories (UL). The junction box 2 may receive electrical wires 9A from an electrical system (e.g., 120 VAC or 277 VAC) within a building or structure in which the recessed lighting system 1 is installed. The electrical wires 9A from the structure may be connected to corresponding wires 9B of the unified casting 5, as will be described in greater detail below.

In one embodiment, the junction box 2 may include one or more tabs 10A, 10B for coupling the junction box 2 to the casting 5. The tabs 10A, 10B may be any device/component for receiving corresponding elements 27A, 27B of the casting 5 to firmly hold the weight of the unified casting 5, the light source module 3, the driver 4, the reflector 6, the lens 7, and/or the trim 8 up against the junction box 2. As shown in FIG. 1, the tabs 10A, 10B include holes for receiving screws or bolts 25A, 25B through the corresponding elements 27A, 27B; however, in other embodiments the tabs 10A, 10B may facilitate a twist-and-lock friction connection with corresponding elements 27A, 27B of the casting 5 and without the use of separate tools or other devices. In still other embodiments, friction or tension clips may be utilized to couple the casting 5 to the junction box 2.

Figure 2:
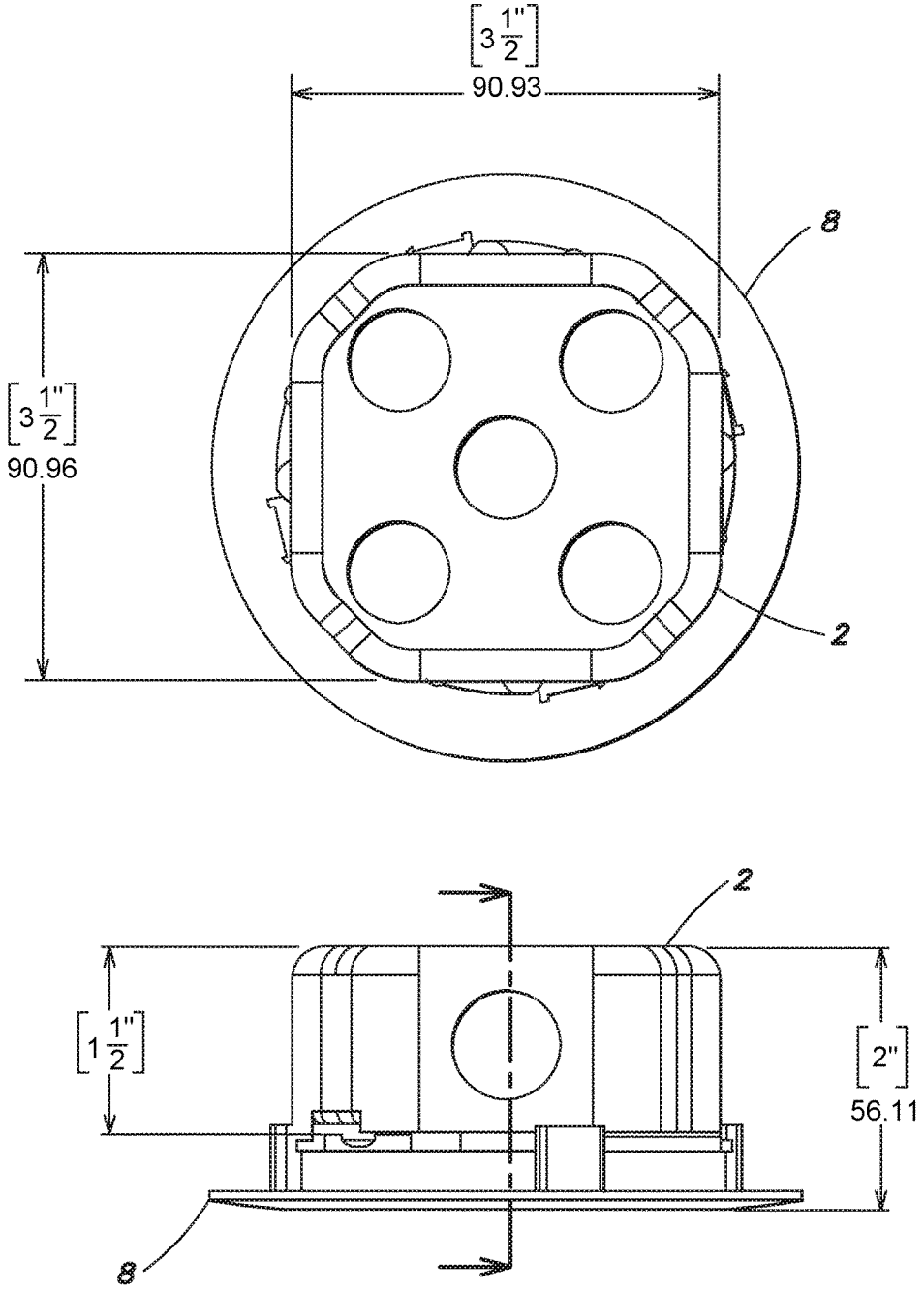
FIG. 2 shows top and side views of a junction box according to one embodiment.

In one embodiment, the junction box 2 acts as a heat barrier to block heat emitted by the light source module 3 and the driver 4 from reaching possibly flammable items inside a ceiling or crawl space. In these embodiments, the junction box 2 may be formed of metals, polymers, metal alloys, and/or other heat insulating materials. As shown in FIG. 1, the junction box 2 may be a polygon that defines a cavity 12 therein. However, in other embodiments, the junction box 2 may be any suitable shape, including an ellipsoid, cone, or cylinder that is capable of receiving therein the casting 5. The cavity 12 that is formed in the junction box 2 may be larger than the casting 5 such that the casting 5 may easily fit into the cavity 12 without coming into direct contact with the walls of the cavity 12. However, in other embodiments, the casting 5 may be sized to come into direct contact with the walls of the cavity 12. The size of the cavity 12 may be pursuant to popular industry specifications for junction boxes and in compliance with all applicable building and safety codes/regulations. For example, as shown in FIG. 2, the junction box 2 may have a length of 3½ inches, a width of 3½ inches and a depth of 1½ inches. When coupled together, the combined junction box 2, light source module 3, driver 4, casting 5, reflector 6, lens 7, and trim 8 may have a height/depth of 2 inches.

Figure 3:
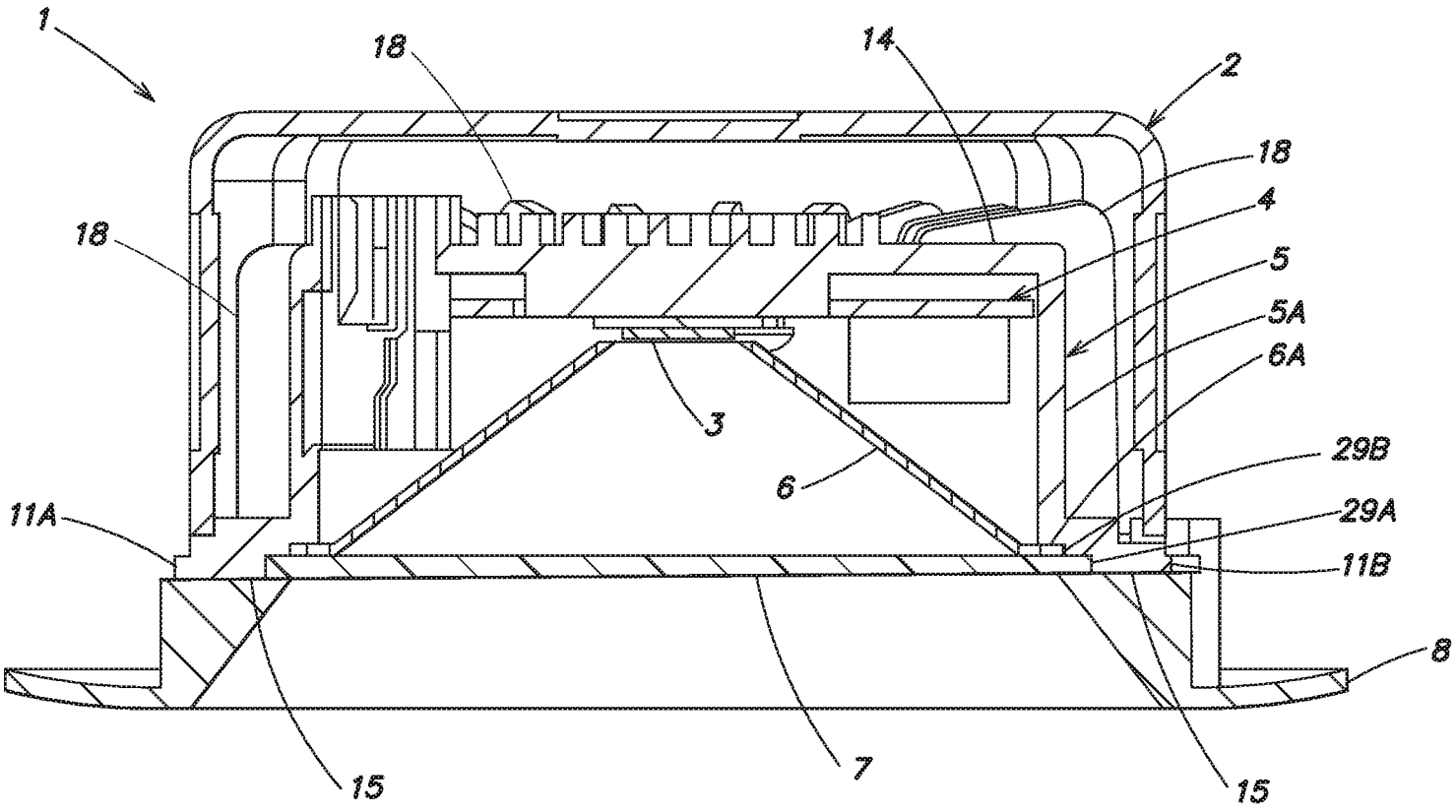
FIG. 3 shows a side view of the recessed lighting system according to one embodiment.

The junction box 2 is a shell and/or enclosure that further prevents the exposure of heat from the light source module 3 and the driver 4 to the items inside a ceiling or crawl space (e.g., insulation) in which the recessed lighting system 1 has been installed. The casting 5 may be formed of metals, polymers, metal alloys, and/or other materials. As shown in FIG. 1, the casting 5 may be a cylindrical structure that defines a casting cavity 13 therein. However, in other embodiments, the casting 5 may be any suitable shape, including an ellipsoid, cone, or polygon that is capable of housing the light source module 3 and the driver 4. As shown in FIGS. 1 and 3, the cavity 13 is to receive therein the light source module 3 and the driver 4.

In one embodiment, the casting 5 may include a closed rear face 14 and an open front face 15*a*. The closed rear face 14 allows the light source module 3 and the driver 4 to be securely mounted to the casting 5, while the open front face 15*a* provides an aperture to allow light emitted by the light source module 3 to be exposed to an outside environment surrounding the recessed lighting system 1 (e.g., into a room). In one embodiment, the rear face 14 of the casting 5 may include one or more mounting elements for receiving and securely holding the light source module 3 and the driver 4. In some embodiments, the mounting elements may be holes, flaps, or other structures designed to receive the light source module 3 and the driver 4. The mounting elements may be capable of receiving resins, clips, screws, bolts, clamps, or any other type of connecting mechanism such that the light source module 3 and the driver 4 may be securely coupled inside the cavity 13 on the rear face 14 of the casting 5. In one embodiment, the light source module 3 and the driver 4 are removably coupled to the casting 5 while in other embodiments one or more of the light source module 3 and the driver 4 form a single continuous and indivisible component with the casting 5.

Although described as a casting 5, the casting 5 may be formed through other processes other than casting techniques. For example, the casting 5 may be formed through an extrusion process or formed through the welding of metal sheets to form a structure. Further, although described as an enclosed assembly, the casting 5 may be any heat conducting structure to which the light source module 3 and the driver 4 are mounted and which can be mounted, using any type of fasteners or mounting elements, to the junction box 2.

In one embodiment, the electrical wires 9A received by the junction box 2 from the electrical system of a building or structure may be coupled to the electrical wires 9B of the casting 5. The electrical wires 9A may be coupled to the electrical wires 9B through the use of electrical caps or other devices. For example, as shown in FIG. 1, the electrical wires 9A and 9B may be connected using the connectors 23A and 23B. The connectors 23A and 23B are complimentary, keyed or interlocking connectors. The electrical wires 9B of the casting 2 may terminate in a connector holder 16 that may receive a corresponding connector 17 of the driver 4. In one embodiment, the connectors 16 and 17 are complimentary, keyed or interlocking connectors similar to the connectors 23A and 23B described above. When the connectors 16 and 17 are engaged, electricity may pass from the electrical system of the building or structure to the driver 4.

In one embodiment, the casting 5 includes one or more heat sinks 18 to dissipate heat generated by the light source module 3 and/or the driver 4. Although the heat sinks 18 are shown as passive components that cool the combined casting 5, light source module 3, and driver 4 by dissipating heat into the surrounding air, active heat sinks (e.g., fans) may also be used. In one embodiment, the heat sinks 18 are defined by a set of fins surrounding the casting 5. The heat sinks 18 may be composed of any thermally conductive material. For example, the heat sinks 18 may be made of aluminium alloys, copper, copper-tungsten pseudoalloy, AlSiC (silicon carbide in aluminium matrix), Dymalloy (diamond in copper-silver alloy matrix), E-Material (beryllium oxide in beryllium matrix), and/or thermally conductive plastics or ceramics.

As described above, the recessed lighting system 1 may include the driver 4. The driver 4 is an electronic device that supplies and/or regulates electrical energy to the light source module 3 and thus powers the light source module 3 to emit light. The driver 4 may be any type of power supply, including power supplies that deliver an alternating current (AC) or a direct current (DC) voltage to the light source module 3. In one embodiment, the driver 4 receives electricity from the casting 5 via a connector. In one embodiment, the connector 17 is coupled to the connector holder 16 of the casting 5 such that electrical wires are not protruding from the casting 5. In this embodiment, the supply connection from the driver 4 terminates in connector 17, which is force-fitted into connector holder 16. In another embodiment, the driver 4 may connect to the supply wires, 9A, via wire nuts.

Upon receiving electricity, the driver 4 may regulate current or voltage to supply a stable voltage or current within the operating parameters of the light source module 3. The driver 4 receives an input current from the electrical system of the building or structure in which the recessed lighting system 1 is installed and drops the voltage of the input current to an acceptable level for the light source module 3 (e.g., from 120V-240V to 36V-48V). The driver 4 may transfer electricity to the light source module 3 through an electrical connector. For example, the driver 4 may deliver electricity to the light source module 3 through an electrical cable coupled between the light source module 3 and the driver 4 through removable or permanent connectors or soldered leads originating from the driver 4. Although shown with magnetic transformer 19, the driver 4 may include additional circuitry for regulating current to the light source module 3.

As shown in FIG. 1, the driver 4 may also include the board 20 for holding the magnetic transformer 19 and other circuitry. In one embodiment, the board 20 is formed in a "donut", torus, or "C" shape with an opening 21. The outside edge of the board 20 is coupled to the casting 5, while the opening 21 formed by the board 20 allows the light source module 3 to be directly coupled to the casting 5 without coming into direct contact with the driver 4. By forming a structure with the opening 21, the driver 4 allows the light source module 3 to avoid the driver 4, eliminating shadows or interference from the driver 4, and allows the light source module 3 to directly contact the casting 5, assisting the casting 5 to dissipate heat generated by the light source module 3. This compact structure allows the light source module 3 and the driver 4 to be contained within the unified casting 5, which in turn may fit inside a standard junction box (i.e., junction box 2) and/or a 4-8 inch recessed lighting fixture (both incandescent and non-incandescent). Accordingly, the recessed lighting system 1 can operate without the use of a "can" housing structure. This simplified and more compact structure reduces the cost and complexity of installing the recessed lighting structure 1 into an existing/pre-installed junction box or a newly installed junction box. Further, this configuration allows the recessed lighting system 1 to achieve a UL fire-rating of at least two hours.

In one embodiment, the board 20 may be a printed circuit board. The driver 4 may be coupled to the casting 5 using any connecting mechanism, including resins, clips, screws, bolts, or clamps. For example, in one embodiment, the driver 4 may be coupled to the casting 5 using friction or tension clips.

The light source module 3 may be any electro-optical device or combination of devices for emitting light. For example, the light source module 3 may have as a single light source a light emitting diode (LED), organic light-emitting diode (OLED), or polymer light-emitting diode (PLED). In some embodiments, the light source module 3 may have multiple light sources (e.g., LEDs, OLEDs, and/or PLEDs). The light source module 3 receives electricity from the driver 4, as described above, such that the light source module 3 may emit a controlled beam of light into a room or surrounding area. The driver 4 is designed to ensure that the approximate voltage and current are fed to the light source module 3 to enable the emission of light by the one or more light sources within the light source module 3.

As described above and shown in FIG. 1, the light source module 3 is coupled to the casting 5 in the opening 21 formed by the board 20. As described above, by positioning the light source module 3 in the opening 21, the light source module 3 may avoid the driver 4, thus eliminating shadows or interference from the driver 4, and allowing the light source module 3 to directly contact the casting 5, such that the casting 5 can dissipate heat generated by the light source module 3. Further, this compact design allows the recessed lighting system 1 to utilize a standard sized junction box (e.g., junction box 2) instead of a "can" housing structure. As shown in FIG. 1, the light source module 3 is coupled to the casting 5 using screws; however, in other embodiments, the light source module 3 may be coupled to the casting 5 using any connecting mechanism, including resins, clips, screws, bolts, or clamps. For example, in one embodiment, the light source module 3 may be coupled to the casting 5 using friction or tension clips. In one embodiment, the casting 5 may include an insulating gasket 25 that separates the board 20 and the casting 5. The insulating gasket 25 may be placed on a groove 24 that encircles the open front face 15*a* of the casting 5. The insulating gasket 25 may be formed of materials that provide some degree of malleability and/or flexibility such that the gasket 25 is able to deform and tightly fit within the groove 24, including any slight irregularities. For example, the insulating gasket 25 may be formed of plastic, rubber, metal, and/or ceramic materials. The insulating gasket 25 assists in insulating the driver 4 from the outside environment.

In some embodiments, the recessed lighting system 1 may include the reflector 6. The reflector 6 may surround the light source module 3 and/or a light source of the light source module 3 to adjust the way light emitted by the light source module 3 is focused inside a room or surrounding area. In one embodiment, the reflector 6 surrounds the light source module 3 and separates the light source module 3 from the driver 4. This separation allows light from the light source module 3 to be emitted into a room or surrounding area while further shielding the driver 4 from being exposed to the room or surrounding area. For example, in one embodiment, the reflector 6 and the casting 5 may be coupled together such that the combined assembly may create a sealed structure to shield the driver 4 from the outside environment and the light source module 3. By shielding the driver 4 from the outside environment, the reflector 6 reduces the risk of fire or other dangers and ensures the recessed lighting system 1 complies with building and safety codes/regulations. The reflector 6 may be formed of any fire retardant material, including steel, aluminum, metal alloys, calcium silicate, and other similar materials.

In one embodiment, the reflector 6 may be coupled to the casting 5 using screws, rivets or other fasteners. The reflector 6 may also be designed as a snap fit into the casting 5.

Although shown as conical, the reflector 6 may be formed in any shape that may direct and/or focus light. For example, the reflector 6 may be parabolic, spherical, or a frusto-conical shape that is positioned over the light source module 3 while shielding the driver 4. In one embodiment, the reflector 6 may be coated with a reflecting material or include one or more reflecting elements that assist in the adjustment of light emitted by the light source module 3. For example, the reflector 6 may be coated with a shiny enamel or include one or more mirrors or retroreflectors or a microcellular polyethylene terephthalate (MCPET) material to adjust the focus of light emitted by the light module 3. In other embodiments, the reflector 6 may include various other optic elements to assist in the focusing of light emitted by the light source module 3.

In one embodiment, the recessed lighting system 1 may include a lens 7. The lens 7 may be formed to converge or diverge light emitted by the light source module 3. The lens 7 may be a simple lens comprised of a single optical element or a compound lens comprised of an array of simple lenses (elements) with a common axis. In one embodiment, the lens 7 also provides a protective barrier for the light source module 3 and shields the light source module 3 from moisture or inclement weather. The lens 7 may also assist in the diffusion of light and increase the uniformity of light over the surface of the recessed lighting system 1. The lens 7 may be made of any at least partially transparent material, including glass and hard plastics. In one embodiment, the lens 7 and the reflector 6 are contained in a single indivisible unit to work in conjunction to focus and adjust light emitted by the light source module 3. In other embodiments, the lens 7 and the reflector 6 are separate, divisible elements as shown in FIG. 1.

In one embodiment, the recessed lighting system 1 may include a trim 8. The trim 8 serves the primary purpose of covering the exposed edge of the ceiling or wall where a hole is formed in which the recessed lighting system 1 resides while still allowing light from the light source module 3 to be emitted into a room through an aperture 22. In doing so, the trim 8 helps the recessed lighting system 1 appear seamlessly integrated into the ceiling or wall. In one embodiment, the trim 8 is capable of coupling to the casting 5 while in other embodiments the trim 8 is capable of coupling to the junction box 2. The trim 8 may couple to the casting 5 and/or the junction box 2 using any connecting mechanism, including resins, clips, screws, bolts, or clamps. In one embodiment, the trim 8 may include grooves and/or slots to couple to corresponding grooves and/or slots of the casting 5 and/or the junction box 2 using a twist-and-lock friction connection and without the use of separate tools or other devices.

In one embodiment, different diameter trims 8 may be capable of being coupled to the casting 5 and/or the junction box 2. The size and design of the trims 8 may depend on the size of the hole in which the recessed lighting system 1 has been fitted and that the trim 8 must conceal, as well as the aesthetic decisions of the consumer. The trims 8 may be made of aluminum plastic polymers, alloys, copper, copper-tungsten pseudoalloy, AlSiC (silicon carbide in aluminum matrix), Dymalloy (diamond in copper-silver alloy matrix), and E-Material (beryllium oxide in beryllium matrix).

As described above, the light source module 3 and the driver 4 may be integrated into the unified casting 5 while shielding the driver 4 from exposure to outside elements through the use of the reflector 6 or the lens 7. Based on this configuration, the compact recessed lighting system 1 provides a more compact design that allows the combined unified casting 5, light source module 3, driver 4, and reflector 6 to be installed in a standard junction box instead of a "can" housing structure to reduce the overall cost of the recessed lighting system 1 while still complying with all building and safety codes/regulations. This configuration also allows the recessed lighting system 1 to achieve a UL fire-rating of at least two hours.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

As shown in FIG. 1 and in FIG. 2, a trim 8 is assembled and retained to housing 5 by interlocking with twist-and-lock flanges 11A, 11B formed integrally with housing 5. The two twist and lock flanges 11A 11B are better seen in FIG. 1 to extend radially from diametrically opposite sides of the front end face 15 integrally with side wall 5*a* of housing 5, and the forward surfaces of the locking flanges 11A 11B are seen to be flush with the front end face 15.

As best seen in FIG. 3 flanges 11A, 11B also are substantially coplanar with the lens 7 as well as coplanar with a first circular rabbet recess 29A defined along an inner edge of front end face 15 and containing the lens 7. Consequently, with the lens installed in the rabbet, the front or exterior surface of lens 7 and forward surfaces of the flanges 11A, 11B define a nearly planar front surface for the compact light.

The unitary structure of the housing 5 and the coplanar location of the trim interlocking flanges 11A, 11B allow a reduction in total height of the compact light as measured between lens 7 and rear wall 14. Such reduced height in turn facilitates installation of the light in a standard but relatively small junction box which already has received a sufficient fire rating, so that the compact light can be installed in a ceiling directly in a j-box without use of a "can", as has been explained previously herein, thus greatly simplifying installation of the compact light.

The rabbet may be a two step rabbet, as seen in FIGS. 1 and 3, such that the lens 7 is held in the larger diameter outer rabbet 29A and a rim 6*a* of reflector 6 is held in the smaller diameter inner rabbet 29B.

What is claimed is:

1. A compact recessed lighting system, comprising:

a light source module for emitting light;

a driver for powering the light source module to emit light, the driver including an electronic device to at least one of supply and regulate electrical energy to the light source module;

a unified casting with a heat conducting closed rear face, a heat conducting sidewall and an open front face wherein the heat conducting sidewall is joined to the heat conducting closed rear face at one end and defines the open front face of the unified casting at another end, wherein the heat conducting sidewall has a first dimension between the heat conducting closed rear face and the open front face of less than 2 inches and extends 360 degrees around a center axis of the unified casting to define a first cavity that extends forward from the heat conducting closed rear face to the open front face of the unified casting and outward to the heat conducting sidewall, wherein the light source module and the driver are positioned inside the first cavity while being coupled to the heat conducting closed rear face of the unified casting such that the light source module is closer to the closed rear face of the unified casting than the open front face of the unified casting, and wherein the unified casting includes a plurality of elements positioned proximate to the open front face so as to align with corresponding tabs of a standard junction box and thereby facilitate holding the unified casting up against the standard junction box when the unified casting is installed in the standard junction box; and a reflector positioned inside the first cavity of the unified casting and coupled to and surrounding the light source module such that the reflector directs light produced by the light source module into an area surrounding the compact recessed lighting system while enclosing the driver from exposure to the area surrounding the compact recessed lighting system, wherein the heat conducting closed rear face and the heat conducting sidewall of the unified casting significantly dissipate heat generated by the light source module during operation of the light source module.

2. The compact recessed lighting system of claim 1, wherein the driver is donut shaped or "C" shaped.

3. The compact recessed lighting system of claim 1, further comprising a trim directly coupled to the unified casting, wherein the trim connects to the unified casting through use of retention clips or springs.

4. The compact recessed lighting system of claim 1, wherein:

the light source module is a light emitting diode (LED) module; and the light source module is coupled to the heat conducting closed rear face of the unitary casting using at least one of a resin, one or more clips, one or more bolts, one or more screws, and one or more clamps.

5. The compact recessed lighting system of claim 1, further comprising:

a lens to shield the light source module while being transmissive to light emitted by the light source module.

6. The compact recessed lighting system of claim 1, further comprising:

an inner enclosure for enclosing the driver within the unified casting.

7. The compact recessed lighting system of claim 1, wherein the heat conducting sidewall of the unified casting has heat sink fins formed on its outside surface.

8. The compact recessed lighting system of claim 1, further comprising:

the standard junction box having a closed rear end, an open front end, and a sidewall surrounding a second cavity, wherein:

the heat conducting closed rear face of the unified casting has a second dimension across the closed rear face that is less than 3½ inches; and the unified casting, with the light source module, the driver and the reflector therein, are substantially contained within the second cavity of the standard junction box.

9. The compact recessed lighting system of claim 8, wherein the unified casting is directly attached to the standard junction box via the plurality of elements of the unified casting and the corresponding tabs of the standard junction box.

10. The compact recessed lighting system of claim 9, further comprising:

a first plurality of wires electrically coupled to the driver, wherein the first plurality of wires passes through the heat conducting closed rear face of the unified casting; and a second plurality of wires that emerge from the standard junction box and that are to bring electricity from an electrical system of a building in which the recessed lighting system is to be installed, wherein the first plurality of wires are connected to the second plurality of wires through a plurality of caps or a connector inside of the standard junction box.

11. The compact recessed lighting system of claim 9, wherein the plurality of elements of the unified casting and the corresponding tabs of the standard junction box facilitate use of at least one of screws, bolts, twist-and-lock connections and friction or tension clips to directly attach the unified casting to the standard junction box.

12. The compact recessed lighting system of claim 8, wherein the standard junction box is a fire rated junction box having an Underwriters Laboratories (UL) fire-rating of at least two hours.

13. The compact recessed lighting system of claim 1, wherein the reflector separates the driver from the light source module such that the reflector directs the light produced by the light source module into an area surrounding the compact recessed lighting system while enclosing the driver from exposure to the area surrounding the compact recessed lighting system.

14. The compact recessed lighting system of claim 1, wherein:

the unified casting includes at least one rabbet proximate to the first cavity; and the heat conducting closed rear face of the unified casting includes one or more mounting elements to receive and hold at least one of the light source module and the driver.

15. The compact recessed lighting system of claim 1, wherein the unified casting includes at least one twist-and-lock connector integrated in the unified casting.

16. The compact recessed lighting system of claim 15, further comprising:

a trim directly coupled to the unified casting, for covering a hole in a ceiling or wall of a building in which the compact recessed lighting system is placed, wherein the trim connects to the unified casting via the at least one twist-and-lock connector.

17. A compact recessed lighting system, comprising:

a light source module for emitting light;

a driver for powering the light source module to emit light, the driver including an electronic device to at least one of supply and regulate electrical energy to the light source module;

a heat conducting unified casting with a closed rear face, a sidewall and an open front face wherein the sidewall is joined to the closed rear face at one end and defines the open front face of the unified casting at another end, wherein the sidewall defines a cavity that extends forward from the closed rear face to the open front face of the unified casting and outward to the sidewall, wherein the light source module and the driver are positioned inside and completely contained within the cavity of the unified casting such that the light source module is closer to the closed rear face of the unified casting than the open front face of the unified casting and sits behind a ceiling or a wall when the unified casting is installed in a hole in the ceiling or the wall; and a reflector positioned inside the cavity of the unified casting and coupled to and surrounding the light source module such that the reflector directs light produced by the light source module into an area surrounding the compact recessed lighting system while enclosing the driver from exposure to the area surrounding the compact recessed lighting system, wherein the heat conducting unified casting significantly dissipates heat generated by the light source module during operation of the light source module.

18. The system of claim 17, wherein:

the light source module is a light emitting diode (LED) module;

the light source module is coupled to the unified casting using at least one of a resin, one or more clips, one or more bolts, one or more screws, and one or more clamps; and the sidewall of the heat conducting unified casting has fins formed on its outside surface.

19. The compact recessed lighting system of claim 17, wherein:

the heat conducting unified casting includes a plurality of elements positioned on the unified casting so as to align with corresponding tabs of a standard-sized junction box.

20. The compact recessed lighting system of claim 17, wherein:

the heat conducting unified casting has at least a first dimension across the closed rear face that is less than 3½ inches and a second dimension along the sidewall, between the closed rear face and the open front face, that is less than 2 inches.

21. The compact recessed lighting system of claim 17, wherein:

the heat conducting unified casting includes a plurality of elements positioned on the unified casting so as to align with corresponding tabs of a standard-sized junction box;

the heat conducting unified casting has at least a first dimension across the closed rear face that is less than 3½ inches and a second dimension along the sidewall, between the closed rear face and the open front face, that is less than 2 inches; and the lighting system further comprises a plurality of wires coupled to the driver and passing through the heat conducting unified casting.

22. A compact recessed lighting system, comprising:

a light source module for emitting light;

a driver for powering the light source module to emit light, the driver including an electronic device to at least one of supply and regulate electrical energy to the light source module;

a unified casting with a closed rear face, a sidewall and an open front face wherein the sidewall is joined to the closed rear face at one end and defines the open front face of the unified casting at another end, wherein the sidewall extends 360 degrees around a center axis of the unified casting to define a cavity that extends forward from the closed rear face to the open front face of the unified casting and outward to the sidewall, wherein the light source module and the driver are positioned inside the cavity of the unified casting such that the light source module is closer to the closed rear face of the unified casting than the open front face of the unified casting; and a reflector positioned inside the cavity of the unified casting and coupled to and surrounding the light source module such that the reflector directs light produced by the light source module into an area surrounding the compact recessed lighting system while enclosing the driver from exposure to the area surrounding the compact recessed lighting system, wherein:

the light source module is a light emitting diode (LED) module;

the sidewall of the unified casting has fins formed on its outside surface; and the system further comprises a plurality of wires connected to the driver and connected to a first connector of a pair of complimentary keyed or interlocking connectors, such that in operation the first connector is coupled to a second connector of the pair of complimentary keyed or interlocking connectors, wherein the second connector is coupled to electricity from an electrical system of a building in which the compact recessed lighting system is installed.

23. The system of claim 22, wherein:

the driver has a shape that allows installation of the driver within the unified casting and allows direct contact of the light source module to the unified casting.

24. The system of claim 23, wherein:

the system further includes the second connector of the pair of complimentary keyed or interlocking connectors, coupled to the first connector of the pair of complimentary keyed or interlocking connectors;

a first end of the plurality of wires is coupled to the first connector of the pair of complimentary keyed or interlocking connectors, and a second end of the plurality of wires is coupled to a connector holder inside the cavity of the unified casting; and the driver includes a corresponding connector that is complimentary to the connector holder inside the cavity of the unified casting, such that when the connector holder and the corresponding connector are engaged, electricity passes from the electrical system of the building to the driver.

25. The compact recessed lighting system of claim 22, wherein:

the unified casting is heat conducting;

the unified casting includes a plurality of elements positioned on the unified casting so as to align with corresponding tabs of a standard-sized junction box; and the sidewall has a first dimension between the closed rear face and the open front face of less than 2 inches.

26. A lighting system, comprising:

a substantially heat conducting unified casting forming a casting cavity having a front face and a rear heat conducting portion and having dimensions to fit inside a standard-sized junction box, the substantially heat conducting unified casting including a plurality of elements positioned on the casting so as to align with corresponding tabs of the standard-sized junction box;

a light source module, disposed in the casting cavity, to emit light, wherein the light source module is positioned in the casting cavity closer to the rear heat conducting portion than the front face of the substantially heat conducting unified casting;

a driver, disposed in the casting cavity, to power the light source module; and a reflector, disposed in the casting cavity to cover the driver and to direct light produced by the light source module out of the front face, wherein the substantially heat conducting unified casting significantly dissipates heat generated by the light source module during operation of the light source module.

27. The lighting system of claim 26, wherein the heat conducting unified casting has a depth dimension of less than 2 inches and at least one of a width dimension and a length dimension of less than 3½ inches.

28. The lighting system of claim 26, further comprising:

a plurality of wires coupled to the driver in the casting cavity and passing through the unified casting and outside the casting cavity, wherein the plurality of wires passes through the rear heat conducting portion of the unified casting, and wherein the lighting system further comprises:

a first connector of a pair of complimentary keyed or interlocking connectors, coupled to a first end of the plurality of wires.

29. The lighting system of claim 26, wherein:

the unified casting includes at least one rabbet proximate to the casting cavity;

the unified casting has a depth dimension of less than 2 inches and at least one of a width dimension and a length dimension of less than 3½ inches;

the unified casting has a closed rear face;

the closed rear face includes one or more mounting elements to receive and hold at least one of the light source module and the driver; and the plurality of wires passes through the closed rear face of the unified casting.

30. The lighting system of claim 26, further comprising an enclosure to substantially contain the unified casting, wherein the enclosure comprises one of:

the standard-sized junction box; and a 4-8 inch recessed lighting fixture.

* * * * *